US011803162B2

(12) United States Patent
Pandya et al.

(10) Patent No.: US 11,803,162 B2
(45) Date of Patent: Oct. 31, 2023

(54) WATCH WITH SEALED HOUSING AND SENSOR MODULE

(71) Applicant: Apple Inc., Cupertino, CA (US)

(72) Inventors: Sameer Pandya, Sunnyvale, CA (US); Daniel J. Hiemstra, Mountain View, CA (US); Zaki Moustafa, Palo Alto, CA (US)

(73) Assignee: Apple Inc., Cupertino, CA (US)

( * ) Notice: Subject to any disclaimer, the term of this patent is extended or adjusted under 35 U.S.C. 154(b) by 554 days.

(21) Appl. No.: 17/033,542

(22) Filed: Sep. 25, 2020

(65) Prior Publication Data

US 2022/0100151 A1 Mar. 31, 2022

(51) Int. Cl.

| | |
|---|---|
| ***G04G 21/00*** | (2010.01) |
| ***A44C 5/14*** | (2006.01) |
| ***G04B 37/08*** | (2006.01) |
| ***G04G 9/00*** | (2006.01) |
| ***G04G 21/06*** | (2010.01) |
| ***G04G 21/04*** | (2013.01) |
| ***G04G 21/08*** | (2010.01) |

(52) U.S. Cl.

CPC ..... *G04G 9/007* (2013.01); *A44C 5/147* (2013.01); *G04B 37/084* (2013.01); *G04G 21/04* (2013.01); *G04G 21/06* (2013.01); *G04G 21/08* (2013.01)

(58) Field of Classification Search

CPC ..... G04B 21/04; G04B 37/084; A44C 5/147; G04G 9/00; G04G 21/04; G04G 21/06; G04G 21/08

See application file for complete search history.

(56) References Cited

U.S. PATENT DOCUMENTS 4,947,179 A * 8/1990 Ganter ..... H01Q 1/273 343/718
5,144,599 A * 9/1992 Blaich ..... G04G 21/04 368/282
6,134,188 A * 10/2000 Ganter ..... H01Q 1/273 368/278

(Continued)

FOREIGN PATENT DOCUMENTS

CN 107850872 A 3/2018
CN 110376874 A 10/2019

(Continued)

OTHER PUBLICATIONS

KR 20170051015 Nam et al. Oct. 2017.*

(Continued)

*Primary Examiner* — Sean Kayes
(74) *Attorney, Agent, or Firm* — BAKERHOSTETLER

(57) ABSTRACT

Wearable electronic devices, such as watches, can provide a seal member to form a fluid barrier between an inner chamber therein and outer chambers, as well as an external environment. Components within the sealed inner chamber can be protected from elements from the external environment (e.g., water ingress, etc.). The components outside of the inner chamber can include sensor modules and the like. Such components can be operatively connected to components within the inner chamber, for example, by a flex circuit that extends across the seal member. The component can interact with a watchband when coupled to a watch housing of the watch.

19 Claims, 8 Drawing Sheets

(56) References Cited

U.S. PATENT DOCUMENTS

| | | | | |
|---|---|---|---|---|
| 6,950,685 | B2 * | 9/2005 | Barras | H01Q 1/273 455/575.1 |
| 9,477,313 | B2 * | 10/2016 | Mistry | G06F 3/017 |
| 9,844,340 | B2 * | 12/2017 | Fish | A61B 5/332 |
| 10,285,643 | B2 | 5/2019 | Perkins et al. | |
| 10,528,006 | B2 * | 1/2020 | Park | A44C 5/14 |
| 10,528,086 | B2 * | 1/2020 | Chung | G04B 37/08 |
| 10,599,101 | B2 | 3/2020 | Fletcher et al. | |
| 10,691,072 | B1 | 6/2020 | Johnson | |
| 11,237,719 | B2 * | 2/2022 | Mistry | G04G 21/00 |
| 11,287,779 | B2 * | 3/2022 | Spencer | G04G 17/06 |
| 11,616,289 | B2 * | 3/2023 | Ahn | H01Q 1/273 343/718 |
| 2014/0143784 | A1 * | 5/2014 | Mistry | G06F 3/0488 718/102 |
| 2015/0070270 | A1 * | 3/2015 | Bailey | A61B 5/1123 345/156 |
| 2016/0026156 | A1 * | 1/2016 | Jackson | G06F 3/04817 368/14 |
| 2016/0058375 | A1 | 3/2016 | Rothkopf | |
| 2016/0223992 | A1 * | 8/2016 | Seo | G04B 37/1486 |
| 2018/0055159 | A1 * | 3/2018 | Park | A44C 5/18 |
| 2018/0227754 | A1 * | 8/2018 | Paez Velazquez | H04L 63/0428 |
| 2018/0343986 | A1 * | 12/2018 | Lukens | G06F 1/163 |
| 2019/0012004 | A1 * | 1/2019 | Kim | G04G 21/00 |
| 2019/0041917 | A1 * | 2/2019 | Chung | G06F 1/163 |
| 2020/0028004 | A1 | 1/2020 | Nagano | |
| 2020/0073338 | A1 | 3/2020 | Liang et al. | |
| 2020/0229761 | A1 | 7/2020 | Pandya et al. | |
| 2022/0151554 | A1 * | 5/2022 | Jang | A61B 5/681 |
| 2022/0187869 | A1 * | 6/2022 | Han | H05K 1/117 |

FOREIGN PATENT DOCUMENTS

| | | |
|---|---|---|
| CN | 210052026 U | 2/2020 |
| GB | 1302668 A | 1/1973 |
| WO | WO 2019/050558 | 3/2019 |

OTHER PUBLICATIONS

Indian Office Action from Indian Patent Application No. 202114038350, dated Apr. 25, 2022, 10 pages.

Chinese Office Action from Chinese Patent Application No. 202110833739.0, dated Jan. 19, 2023, 27 pages including English language translation.

* cited by examiner

WATCH WITH SEALED HOUSING AND SENSOR MODULE

TECHNICAL FIELD

The present description relates generally to securement of wearable devices, and, more particularly, to watches with sensor modules that are arranged to maintain a sealed enclosure within the watches.

BACKGROUND

Portable electronic devices have become increasingly popular, and the features and functionality provided by portable electronic devices continue to expand to meet the needs and expectations of many consumers. As such devices become more useful, users tend to keep the devices with them throughout the day. Some devices, such as wristwatches, are frequently carried or worn by users and exposed to a variety of conditions. For example, users may wear a watch while exercising, swimming, and bathing. As such, many watches are designed with waterproof features to protect the internal components from an external environment.

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form in order to avoid obscuring the concepts of the subject technology.

Consumer products, such as wearable electronic devices, can include various parts that are assembled together. The assembly can include a housing to contain internal components and a cover member to cover the internal components from an external environment. With some products, such as electronic devices, it can be beneficial to isolate the internal components from fluid or foreign objects. For example, it can be desirable to provide a waterproof enclosure to an electronic device so the device can safely be worn during exposure to water.

However, some components need not be contained within a sealed chamber to operate. Accordingly, such components can provide functionality without requiring that a sealed chamber extend to their location. By reducing the need to extend the sealed chamber to enclose all components, the seal can be improved while components outside the sealed chamber provide their own protective barriers.

Embodiments of the present disclosure provide an assembly for a consumer product, such as a watch, that provides a seal member to form a fluid barrier between an inner chamber therein and outer chambers, as well as an external environment. The components outside of the inner chamber can include sensor modules and the like. Such components can be operatively connected to components within the inner chamber, for example, by a flex circuit that extends across the seal member. The component can interact with a watchband when coupled to a watch housing of the watch.

These and other embodiments are discussed below with reference to FIGS. 1-11. However, those skilled in the art will readily appreciate that the detailed description given herein with respect to these Figures is for explanatory purposes only and should not be construed as limiting.

Figure 1:
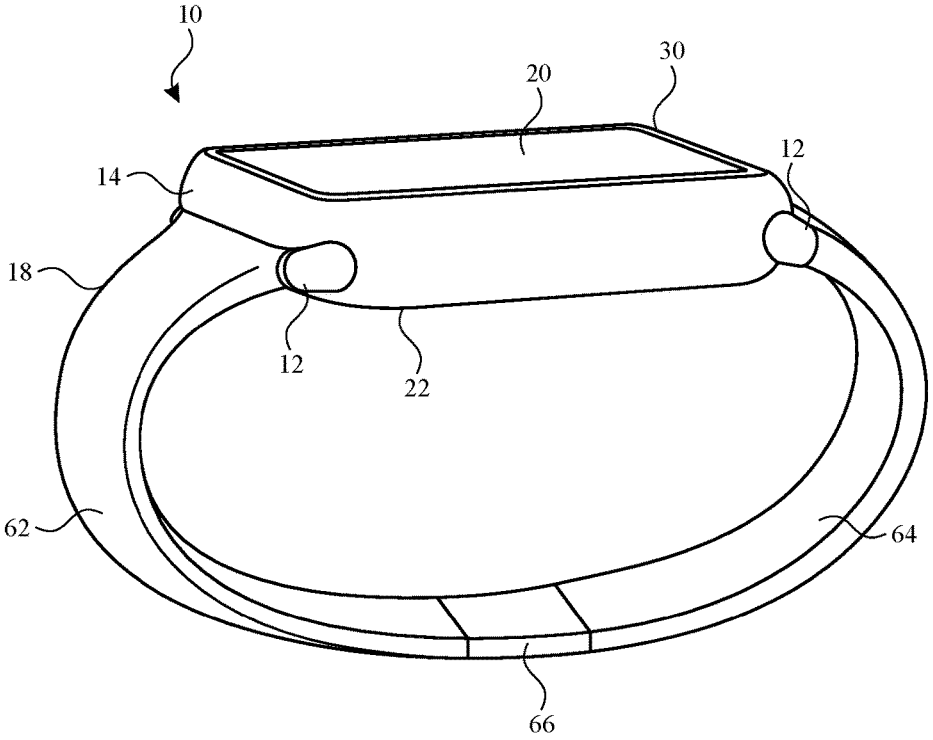
FIG. 1 is a perspective view of a watch, in accordance with some embodiments of the present disclosure.

FIG. 1 illustrates a watch 10 including a watch housing 30 that is useable with an attachment unit 12 of an attachment system according to one or more embodiments of the present disclosure. It will be appreciated that the teachings relating to a watch can be applied to other electronic devices, including wearable and/or portable computing devices. Examples include cell phones, smart phones, tablet computers, laptop computers, timekeeping devices, computerized glasses and other wearable devices navigation devices, sports devices, accessory devices, health-monitoring devices, medical devices, wristbands, bracelets, jewelry, and/or the like.

According to some embodiments, one of the components included in the watch 10 can be one or more I/O systems. For example, the watch 10 can include a touchscreen 20 configured to output various information about the watch 10. The touchscreen 20 of the watch 10 can also be configured to receive input. The watch 10 can also have other input and output mechanisms. For example, the watch 10 can include or interface with one or more buttons, a crown, keys, dials, trackpads, microphones and the like.

The watch 10 can include a watch housing 30 and one or more attachment units 12 capable of being removably coupled to a main body 14 of the watch housing 30. The watch housing 30 serves to surround a peripheral region of the watch 10 as well as support the internal components of the watch 10 in their assembled position. For example, the watch housing 30 encloses and supports various internal components (including for example integrated circuit chips, processors, memory devices and other circuitry) to provide computing and functional operations for the watch 10.

The watch 10 can utilize a watchband 18 for attaching the watch 10 to a wrist. For example, as shown in FIG. 1, the watchband 18 can include a first band strap 62 attached to a first attachment unit 12 of the watch 10 and a second band strap 64 attached to a second attachment unit 12 of the watch 10. In some embodiments, free ends of the first band strap 62 and the second band strap 64 can be configured to be releasably attached or secured to one another using a clasp 66 or other attachment mechanism to form a loop. This loop can then be used to attach the watch 10 to a user's wrist.

Although a single attachment unit 12 is discussed herein, a plurality of attachment units 12 can be coupled to the watch housing 30. When multiple attachment units 12 are used, as shown in FIG. 1, the watch housing 30 can have a band retaining feature (e.g., channel 16, latch, clip, recess, lock or other such coupling node) on a first side and a second side of the main body 14. While the band retaining feature of FIG. 1 is shown as a channel, it will be understood that other retention mechanisms can be applied. The channel 16 on the first side of the main body 14 of the watch housing 30 can receive one of the attachment units 12 and the channel 16 on the second side of the main body 14 of the watch housing 30 can receive another attachment unit 12. The attachment units 12 can have a same or different size and/or shape, wherein the size and/or shape corresponds to a size and/or shape of the respective channel 16.

Figure 2:
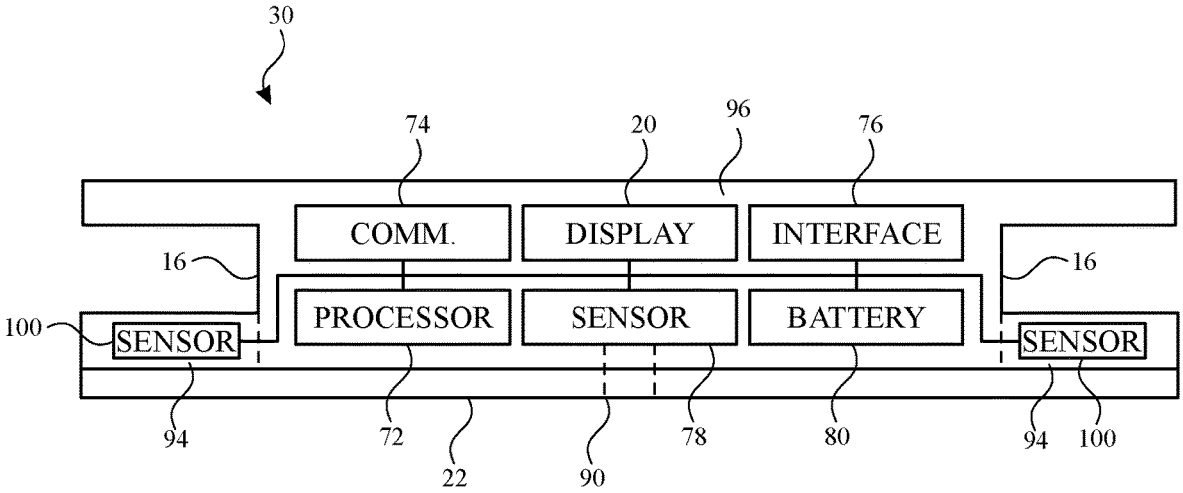
FIG. 2 is a side view of a watch housing, in accordance with some embodiments of the present disclosure.

According to some embodiments, for example as shown in FIGS. 1 and 2, the main body 14 includes one or more channels 16 that mechanically engage a corresponding attachment unit 12. The channels 16 on the main body 14 include an opening while the attachment unit 12 includes a lug that fits within the opening. The opening can be configured in a variety of different shapes and orientations. Further, the opening is configured to removably receive the lug such as will be described in detail below.

As further illustrated in FIG. 2, the watch 10 can include components for performing various functions, including interacting with a user. Some of the components can be provided within an inner chamber 96 that is sealed with respect to one or more outer chambers 94 and/or an external environment, as described further herein.

For example, the watch 10 can include components for interacting with a user. The touchscreen 20 can provide visual (e.g., image or video) output for the watch 10. The touchscreen 20 may also provide an input surface for one or more touch input devices such as a touch sensing device, force sensing device, temperature sensing device, and/or a fingerprint sensor. The touchscreen 20 may be any size suitable for inclusion at least partially within the housing of the watch 10 and may be positioned substantially anywhere on the watch 10.

The watch 10 can further include one or more other user interfaces 76 for receiving input from and/or providing output to a user. For example, one or more buttons, dials, crowns, switches, or other devices can be provided for receiving input from a user. The user interface 76 can include a speaker, a microphone, and/or a haptic device. A haptic device can be implemented as any suitable device configured to provide force feedback, vibratory feedback, tactile sensations, and the like. For example, in one embodiment, the haptic device may be implemented as a linear actuator configured to provide a punctuated haptic feedback, such as a tap or a knock.

As further shown in FIG. 2, the watch 10 includes one or more processing units 72 that include or are configured to access a memory having instructions stored thereon. The instructions or computer programs may be configured to perform one or more of the operations or functions described with respect to the watch 10. The processing units 72 can be implemented as any electronic device capable of processing, receiving, or transmitting data or instructions. For example, the processing units 72 may include one or more of: a microprocessor, a central processing unit (CPU), an application-specific integrated circuit (ASIC), a digital signal processor (DSP), or combinations of such devices. As described herein, the term "processor" is meant to encompass a single processor or processing unit, multiple processors, multiple processing units, or other suitably configured computing element or elements. The memory can store electronic data that can be used by the watch 10. For example, a memory can store electrical data or content such as, for example, audio and video files, documents and applications, device settings and user preferences, timing and control signals or data for the various modules, data structures or databases, and so on. The memory can be configured as any type of memory. By way of example only, the memory can be implemented as random access memory, read-only memory, Flash memory, removable memory, or other types of storage elements, or combinations of such devices.

As further shown in FIG. 2, the watch 10 may include a communication component 74 that facilitates transmission of data and/or power to or from other electronic devices across standardized or proprietary protocols. For example, a communication component 74 can transmit electronic signals via a wireless and/or wired network connection. Examples of wireless and wired network connections include, but are not limited to, cellular, Wi-Fi, Bluetooth, infrared, RFID and Ethernet.

As further shown in FIG. 2, the watch 10 may also include one or more user sensors 78, such as biosensors, positioned substantially anywhere on the watch 10. The one or more user sensors 78 may be configured to sense substantially any type of characteristic such as, but not limited to, images, pressure, light, touch, force, temperature, position, motion, and so on. For example, the user sensor(s) 78 may be a photodetector, a temperature sensor, a light or optical sensor, an atmospheric pressure sensor, a humidity sensor, a magnet, a gyroscope, an accelerometer, and so on. In other examples, the watch 10 may include one or more health sensors. In some examples, the health sensors can be disposed on a bottom surface of the housing of the watch 10, such as near the rear cover 22. The one or more user sensors 78 can include optical and/or electronic biometric sensors that may be used to compute one or more biometric characteristic. A user sensor 78 can include a light source and a photodetector to form a photoplethysmography (PPG) sensor. Light can be transmitted from the user sensor 78, to the user, and back to the user sensor 78. For example, the main body 14 and/or the rear cover 22 can provide one or more windows 90 (e.g., opening, transmission medium, and/or lens) to transmit light to and/or from the user sensor 78. The optical (e.g., PPG) sensor or sensors may be used to compute various biometric characteristic including, without limitation, a heart rate, a respiration rate, blood oxygenation level, a blood volume estimate, blood pressure, or a combination thereof. One or more of the user sensors 78 may also be configured to perform an electrical measurement using one or more electrodes. The electrical sensor(s) may be used to measure electrocardiographic (ECG) characteristics, galvanic skin resistance, and other electrical properties of the user's body. Additionally or alternatively, a user sensor 78 can be configured to measure body temperature, exposure to UV radiation, and other health-related information.

The rear cover 22 can provide one or more electrodes to provide an electrically conductive pathway through or along the rear cover 22. The electrodes 92 can be operated to perform an electrical measurement, for example, to measure electrocardiographic (ECG) characteristics, galvanic skin resistance, and other electrical properties of the user's body and/or the environment.

The rear cover 22 can provide one or more other modules providing additional functionality. The one or more modules can facilitate measurements of body temperature, exposure to UV radiation, and other health-related information. The one or more modules can be configured to provide or facilitate detection of images, pressure, light, touch, force, temperature, position, motion, and so on. The one or more modules can include or facilitate operation of a temperature sensor, a light or optical sensor, an atmospheric pressure sensor, a humidity sensor, a magnet, a gyroscope, an accelerometer, and so on.

As further shown in FIG. 2, the watch 10 may include a battery 80 that is used to store and provide power to the other components of the watch 10. The battery 80 may be a rechargeable power supply that is configured to provide power to the watch 10. The watch 10 may also be configured to recharge the battery 80 using a wireless charging system.

As further shown in FIG. 2, one or more components can be provided in an outer chamber 94 that is separated from the inner chamber 96. For example, one or more outer chambers 94 can contain a sensor module 100. The sensor module 100 can be positioned to detect, communicate with, and/or otherwise interact with a watch band when inserted into the channel 16. For example, the sensor module 100 can include a near-field communication module with an antenna assembly for detecting and/or communicating with a corresponding component in the watch band, as described further herein. It will be understood that such components can operate outside of the inner chamber 96. While the inner chamber 96 is fluidly sealed, the sensor module 100 may not need such protection and/or may provide its own fluid barrier as needed.

The outer chamber 94 can contain one or more other modules providing additional functionality. The one or more modules can include an RFID device, a microphone, a haptic feedback device, an altimeter, and the like. The one or more modules can facilitate measurements of body temperature, exposure to UV radiation, and other health-related information. The one or more modules can be configured to provide or facilitate detection of images, pressure, light, touch, force, temperature, position, motion, and so on. The one or more modules can include or facilitate operation of a temperature sensor, a light or optical sensor, an atmospheric pressure sensor, a humidity sensor, a magnet, a gyroscope, an accelerometer, and so on. The main body 14 and/or the rear cover 22 can include an opening extending partially or entirely there through to provide exposure to an external environment, for example, for measurements. Such exposure can be provided to the outer chamber(s) 94 while the inner chamber 96 remains fluidly isolated.

Figure 3:
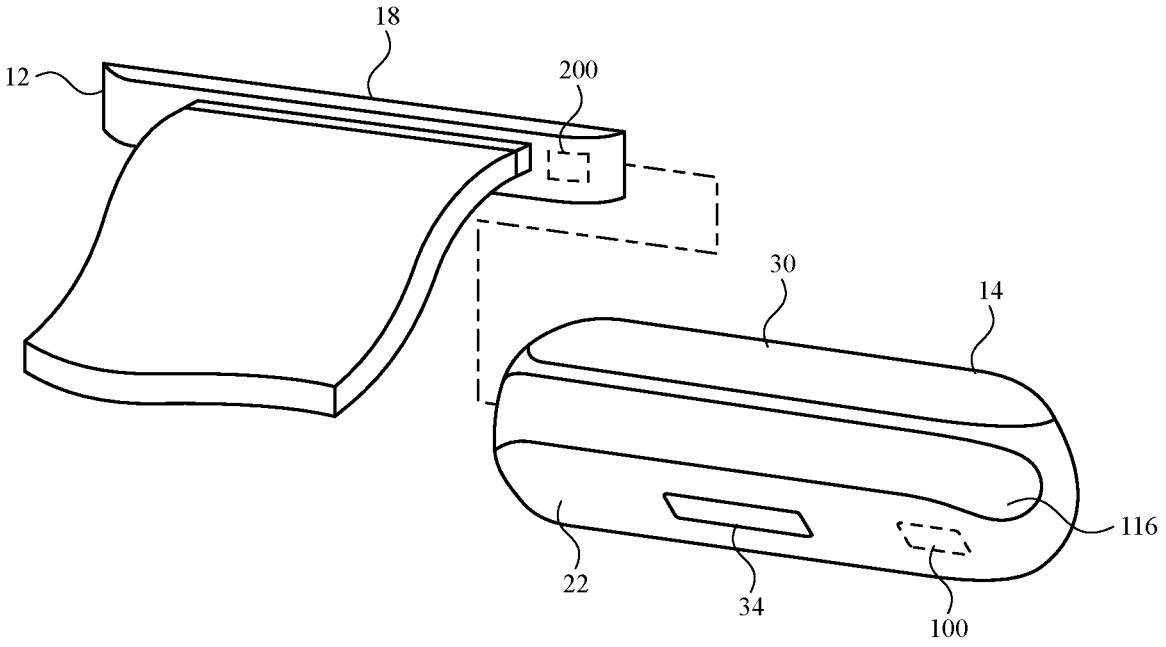
FIG. 3 is a perspective view of a watch housing and a watchband connector, in accordance with some embodiments of the present disclosure.

According to some embodiments, for example as shown in FIG. 3, the attachment unit 12 can be laterally inserted into the channel 16 of the main body 14. As such, the attachment unit 12 can be configured to slide relative to the main body 14 of the watch 10. Alternatively or additionally, the attachment unit 12 can be pressed, snap fit or otherwise forwardly inserted into the channel 16 of the main body 14. Once inserted, the attachment unit 12 can be locked or otherwise secured within the main body 14. For example, a locking mechanism (e.g., a lug) can engage at least a housing opening (e.g., provided by the rear cover 22) within the channel 16.

The watch housing 30 can include the sensor module 100, for example, between the main body 14 and the rear cover 22 at a location adjacent to the channel 16. The watchband 18 can include an NFC module 200, for example in the attachment unit 12 that is inserted into the channel 16. The sensor module 100 of the watch housing 30 can detect, communicate with, and/or otherwise interact with the NFC module 200 of the watchband 18 when it is coupled to the watch housing 30.

Figure 4:
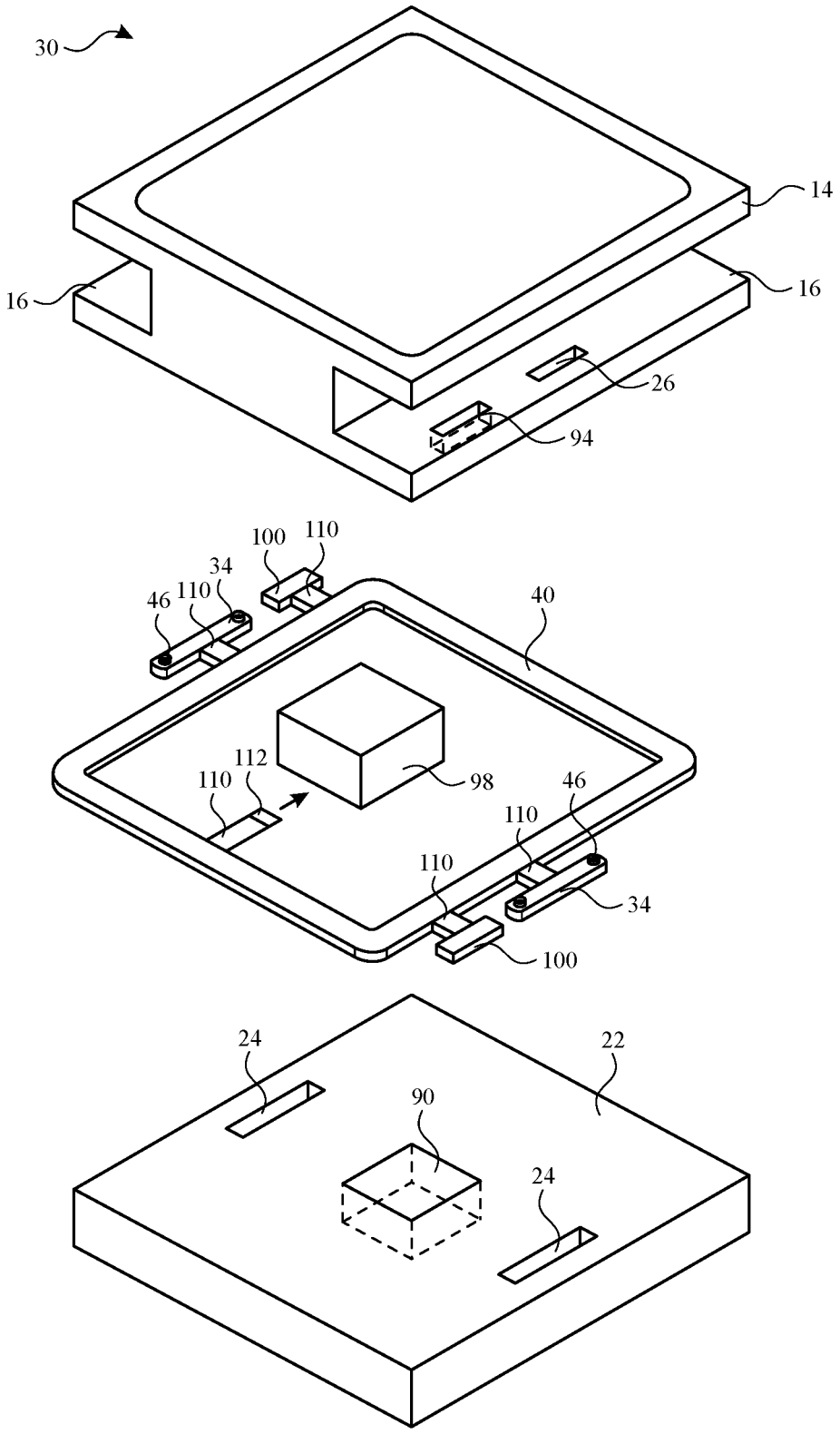
FIG. 4 is an exploded perspective view of a watch housing, in accordance with some embodiments of the present disclosure.

FIG. 4 illustrates an exploded perspective view of a watch housing according to one or more embodiments of the present disclosure. As shown, a seal member 40 can be provided between the main body 14 and the rear cover 22. The seal member 40 can be a compliant ring that extends circumferentially about and/or against a portion of the main body 14 and the rear cover 22. The seal member 40 can be continuous to form a closed loop. The seal member 40 can form any shape. The seal member 40 can be of an elastic material the serves as a mechanical gasket when placed between the main body 14 and the rear cover 22. For example, the seal member can include nitrile, silicone, another polymer, or combinations thereof.

While the seal member 40 is illustrated as being positioned axially between the main body 14 and the rear cover 22, it will be understood that the seal member 40 can also be positioned elsewhere, such as radially between protruding walls of the main body 14 and/or the rear cover 22. The seal member 40 forms a fluid barrier between the main body 14 and the rear cover 22. For example, the seal member 40 forms a watertight, water-resistant, and/or airtight seal. Accordingly, internal components 98 within an internal space of the watch housing 30 can be protected from elements of the external environment. Such components can include one or more of those described herein as being within an inner chamber (see FIG. 2), such as a processor.

One or more sensor modules 100 can be provided outside of the seal member 40. The sensor modules 100 can fit within outer chambers 94, which can be at least partially defined by the main body and/or the rear cover 22.

The assembly can include a flex circuit 110 that operably connects components of the assembly to each other and/or other components. As used herein, "flexible circuit" or "flex circuit" is a structure that includes a conductive layer, an insulation layer, and optionally a substrate layer. A flex circuit can be provided in electrical communication with at least one electrode, terminal, and/or connector. A flex circuit forms circuitry that includes a pattern of conductors of the conductive layer typically in the form of pads, which are typically formed on a surface of an insulating material of the insulation layer. Such circuitry is typically metallic, such as of a copper or copper alloy. In general, a flex circuit is thin, having a total thickness of from about 1 mm to about 30 mm. A flex circuit is generally flexible, such that it can conform to contours of other components. A flex circuit may be any suitable size, and constructed in any suitable shape. For example, the size of a flex circuit may be determined by the power requirements of the components connected thereto (e.g., sensor module 100), the conductivity of the flex circuit, the distance between operably connected components, or any other suitable criteria.

The flex circuit 110 can operably connect the sensor modules 100 to one or more internal components 98. For example, the flex circuit 110 can have, at an end portion thereof, a connector 112 for providing electrical communication through the circuitry of the flex circuit 110 to the internal components 98. A portion of the flex circuit 110 can extend outside of a boundary defined by the seal member 40 (e.g., to the sensor modules 100). A portion of the flex circuit 110 can extend inside of a boundary defined by the seal member 40 (e.g., to the internal components 98). A portion of the flex circuit 110 can extend across and/or along the seal member 40. For example, end portions of the flex circuit 110 can extend outside of the seal member 40 at opposite sides thereof, and the flex circuit 110 can extend along only a portion of the seal member 40 to connect to another end portion (e.g., at the connector 112) that is within the seal member 40.

It will be understood that other mechanisms can be provided in addition to and/or in place of the flex circuit 110. For example, operable connections can be made with any conductive circuit, wires, leads, and/or connectors between components and extending outside, within, across, and/or along the seal member 40.

One or more buttons 34 can be positioned between the rear cover 22 and the main body 14. By providing the rear cover 22 and the main body 14 on opposite sides of the button 34, the watch 10 can be assembled to contain the button 34. Each button 34 is aligned with a corresponding housing opening 26 of the main body 14. The housing opening 26 extends through the main body 14 at least to the channels 16. According to some embodiments, each button 34 is aligned with a cover opening 24 of the rear cover 22. The cover opening 24 extends through the rear cover 22 to opposite surfaces thereof. The rear cover 22 can be placed on the main body 14 so that the button 34 is secured within the housing opening 26 and the cover opening 24. The user can access the button 34 at the cover opening 24 of the rear cover 22. The button 34 can be movable through at least part of the cover opening 24 and the housing opening 26 while the rear cover 22 is affixed to the main body 14.

The buttons 34 can be biased to a rest position. One or more spring elements 46 can be provided between the button 34 and the main body 14. According to some embodiments, the spring elements 46 can include a coil spring, a compression spring, a leaf spring, a torsion spring, cantilever spring, or a structure of an elastic material. The spring elements can bias the button 34 into the cover opening 24 or against the rear cover 22. The spring elements 46 can also bias the button 34 away from the channel 16, the main body 14, the housing opening 26, and/or the attachment unit when it is within the channel 16.

The flex circuit 110 can extend to the buttons 34 to operably connect to sensor modules contained within the buttons 34, as described further herein. The portions of the flex circuit 110 that connect to the buttons 34 can facilitate movement of the button 34 while maintaining a connection there with. While the flex circuit 110 is shown connecting to multiple sensor modules 100 and multiple buttons 34, it will be understood that the flex circuit 110 can optionally connect to only one or more sensor modules 100 or to only one or more buttons 34.

Figure 5:
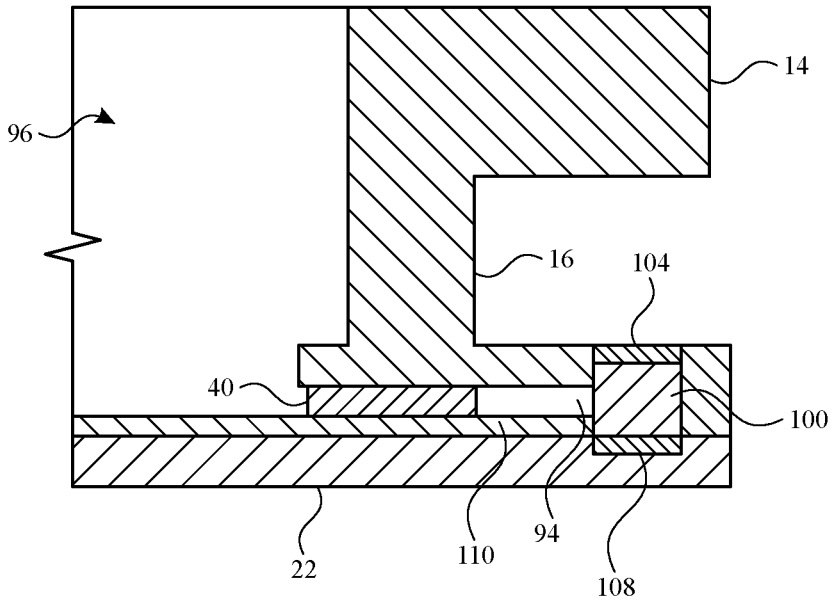
FIG. 5 is a sectional view of a watch housing, in accordance with some embodiments of the present disclosure.

FIG. 5 illustrates a sectional view of a watch housing according to one or more embodiments of the present disclosure. As shown in FIG. 5, the watch housing defines an inner chamber 96 and an outer chamber 94. Both the inner chamber 96 and an outer chamber 94 can be formed between the main body 14 and the rear cover 22. The inner chamber 96 and the outer chamber 94 are separated by a seal member 40 that provides a fluid barrier there between.

Within the outer chamber 94, the sensor module 100 can be positioned. A cap 104 can couple the sensor module 100 to the channel 16 of the main body 14. For example, the cap 104 can define at least a portion of a surface of the channel 16. The sensor module 100 within the outer chamber 94 can be biased against the cap 104 and/or the main body 14. For example, an elastic insert 108 can be positioned between the sensor module 100 and the rear cover 22 to bias the sensor module 100. While within the housing, the elastic insert 108, under compression, biases the sensor module 100 against the cap 104 and/or the main body 14. The elastic insert 108 can include one or more of a variety of materials to provide such biasing under compression. For example, the elastic insert 108 can include a foam body, an elastomer, a matrix material, or another material having elastic properties. The elastic insert 108 can include an adhesive for bonding the sensor module 100 to the rear cover 22.

As further shown in FIG. 5, the flex circuit 110 can extend across and/or along the seal member 40 to extend into the outer chamber 94 and the inner chamber 96. The flex circuit 110 can overlap at least somewhat with the seal member 40 along a length thereof.

Figure 6:
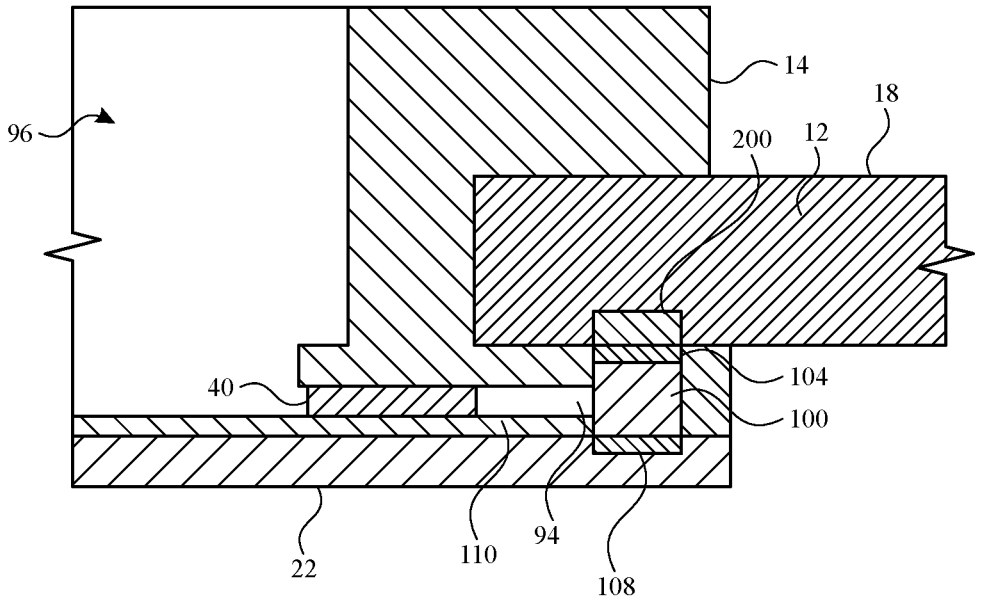
FIG. 6 is a sectional view of a watch housing and a watchband connector, in accordance with some embodiments of the present disclosure.

FIG. 6 illustrates a sectional view of a watch housing with a watchband according to one or more embodiments of the present disclosure. The attachment unit 12 of a watchband 18 is shown within the channel 16, which separates portions of the main body 14 from each other. While the attachment unit 12 is within the channel, the NFC module 200 of the watchband 18 can be aligned with the sensor module 100 of the housing. Accordingly, the sensor module 100 and the NFC module 200 can be in close proximity to each other for detection, communication, and/or other interactions there between. The cap 104 can provide a window for transmission of signals there between. For example, the cap 104 can transmit electromagnetic (e.g., wireless) signals there through to provide communication between the sensor module 100 and the NFC module 200.

Figure 7:
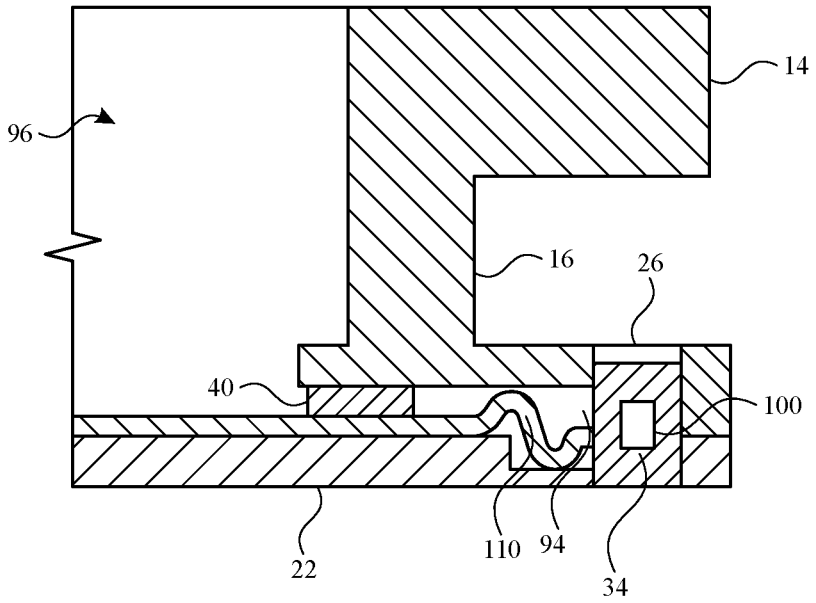
FIG. 7 is a sectional view of a watch housing, in accordance with some embodiments of the present disclosure.

FIG. 7 illustrates a sectional view of a watch housing according to one or more embodiments of the present disclosure. As shown in FIG. 7, the watch housing defines an inner chamber 96 and an outer chamber 94. Both the inner chamber 96 and the outer chamber 94 can be formed between the main body 14 and the rear cover 22. The inner chamber 96 and the outer chamber 94 are separated by a seal member 40 that provides a fluid barrier there between.

Within the outer chamber 94, a button 34 containing a sensor module 100 can be positioned. As further shown in FIG. 7, the flex circuit 110 can extend across and/or along the seal member 40 to extend into the outer chamber 94 and the inner chamber 96. The flex circuit 110 can overlap at least somewhat with the seal member 40 along a length thereof. Within the outer chamber 94, the flex circuit 110 can form a serpentine shape to facilitate movement of the button 34 while maintaining a connection therewith.

The button 34 includes a portion that can extend at least partially through the cover opening 24. This portion can be accessed by a user for actuation. In a rest position (e.g., when not actuated by a user), this portion can be flush with a surface of the rear cover 22. The button 34 further includes another portion that can extend at least partially through the housing opening 26.

Figure 8:
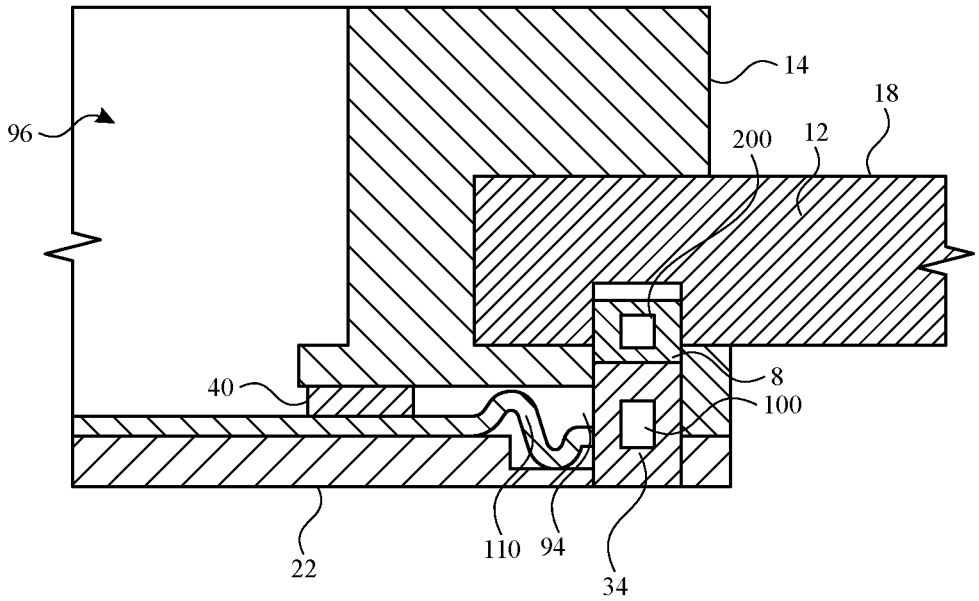
FIG. 8 is a sectional view of a watch housing and a watchband connector, in accordance with some embodiments of the present disclosure.

FIG. 8 illustrates a sectional view of a watch housing with a watchband according to one or more embodiments of the present disclosure. The attachment unit 12 of a watchband 18 is shown within the channel 16, which separates portions of the main body 14 from each other. A locking mechanism (e.g., lug 8) of the attachment unit 12 engages within the housing opening 26 when aligned therewith. In this position, the attachment unit 12 is unable to move within or be removed from the channel 16 until the lug 8 is released form the housing opening 26.

While the attachment unit 12 is within the channel, the NFC module 200 of the watchband 18 can be aligned with the sensor module 100 of the button 34. Accordingly, the sensor module 100 and the NFC module 200 can be in close proximity to each other for detection, communication, and/or other interactions there between. The button 34 can provide a window for transmission of signals there between. For example, the button 34 can transmit electromagnetic (e.g., wireless) signals there through to provide communication between the sensor module 100 and the NFC module 200.

Figure 9:
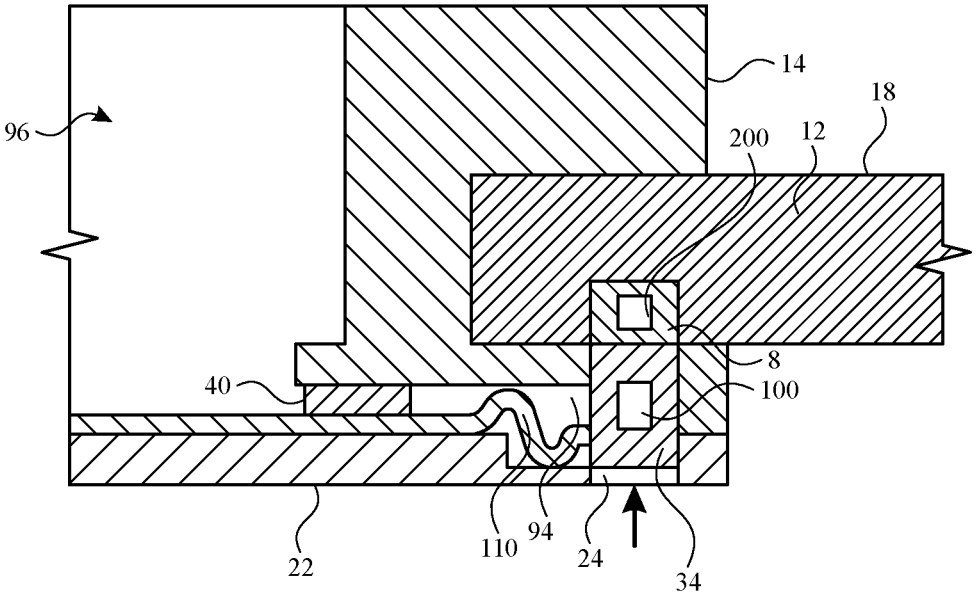
FIG. 9 is a sectional view of a watch housing and a watchband connector, in accordance with some embodiments of the present disclosure.

FIG. 9 illustrates a sectional view of the watch housing and watchband of FIG. 8 with the button actuated by a user according to one or more embodiments of the present disclosure. To release the attachment unit 12 from the channel 16, the button 34 is actuated. When actuated, the button 34 can move so that the upper portion of the button 34 moves towards and partially through the housing opening 26. Actuation of the button 34 expels the lug 8 from the housing opening 26. As shown in FIG. 9, this also enables the attachment unit 12 to once again freely move or slide within the channel 16 of the main body 14 or be pulled out from the front face of the channel 16. For example, when actuated, the button 34 can move so that the upper portion of the button 34 is flush with a surface of the channel 16. When released, the button 34 can return to the rest position by action of the spring elements.

Figure 10:
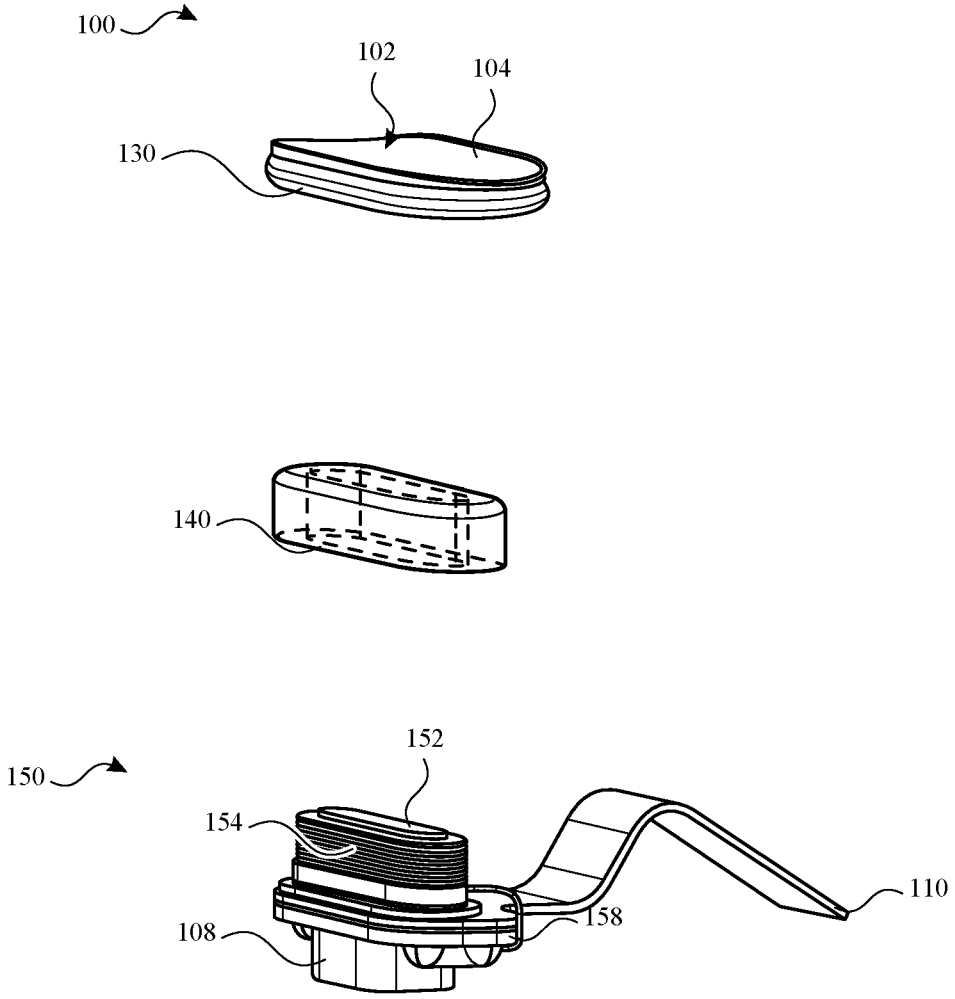
FIG. 10 illustrates an exploded perspective view of a near-field communications module for a watch housing, in accordance with some embodiments of the present disclosure.

FIG. 10 illustrates an exploded perspective view of a near-field communications module for a watch housing, in accordance with some embodiments of the present disclosure. The NFC module of FIG. 10 can correspond to the sensor module 100 of a watch housing 30.

As shown in FIG. 10, the sensor module 100 can include an antenna assembly 150 that includes antenna 154 implemented as a wound coil that is wound around a core structure 152. Core structure 152 may be a plastic structure that is provided primarily for support of antenna 154, or may be a magnetic (e.g., ferrite) core that supports antenna 154 and enhances the efficiency of antenna 154.

In the example of FIG. 10, antenna assembly 150 includes a portion of flex circuit 110 that is supported by stiffener layer 158. Elastic insert 108 (e.g., foam) is provided on stiffener layer 158 (e.g., to encapsulate leads for antenna 154 as described in further detail hereinafter).

In the example of FIG. 10, cap 104 can be secured by adhesive 130 to the main body (e.g., at the channel). A filler 140, such as a glue, adhesive, or potting material can be provided between the cap 104 and the antenna 154 to secure antenna assembly 150 to cap 104 and/or to fill the space between antenna assembly 150 and cap 104. The cap 104 can provide protection to the components of the antenna assembly 150, as they are to be positioned outside of the seal member.

Figure 11:
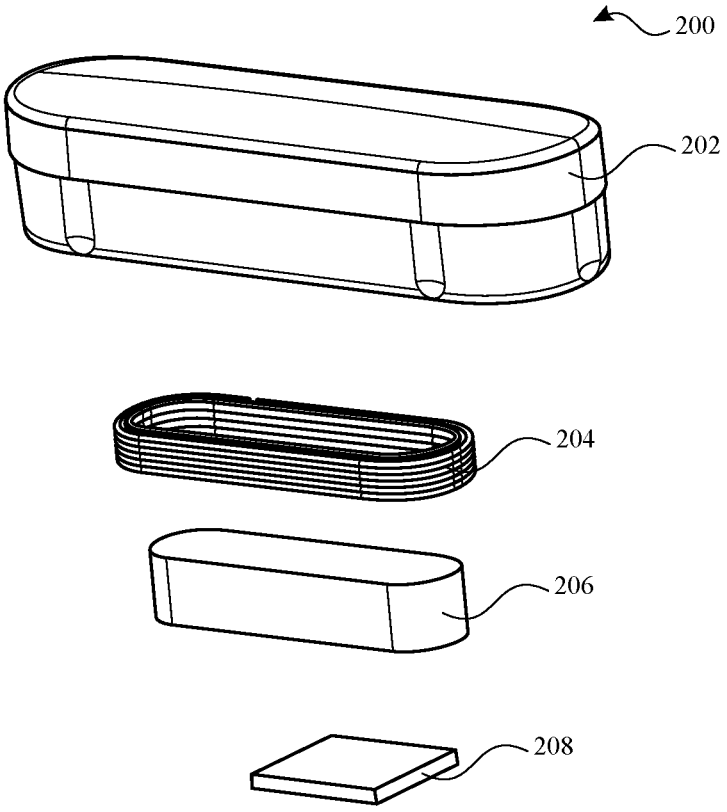
FIG. 11 illustrates an exploded perspective view of a near-field communications module for a watchband, in accordance with some embodiments of the present disclosure.

FIG. 11 illustrates an exploded perspective view of a near-field communications module for a watchband, in accordance with some embodiments of the present disclosure. As shown in FIG. 11, NFC module 200 may include a band module housing 202, within which antenna 204, memory 208 (e.g., an NFC tag chip), and an antenna filler 206 may be disposed. Antenna filler 206 may be a plastic support structure or a magnetic (e.g., ferrite) structure that supports and/or enhances the efficiency of antenna 204. In the example of FIG. 11, antenna 204 is implemented as a wound coil. However, it should be appreciated that antenna 204 can be implemented in other configurations, such as by one or more winding traces in a printed circuit board.

Accordingly, embodiments of the present disclosure provide an assembly for a consumer product, such as a watch, that provides a seal member to form a fluid barrier between an inner chamber therein and outer chambers, as well as an external environment. The components outside of the inner chamber can include sensor modules and the like. Such components can be operatively connected to components within the inner chamber, for example, by a flex circuit that extends across the seal member. The component can interact with a watchband when coupled to a watch housing of the watch.

Various examples of aspects of the disclosure are described below as clauses for convenience. These are provided as examples, and do not limit the subject technology.

Clause A: a watch comprising: a main body having a band retaining feature for receiving a watchband; a rear cover; a seal member between the main body and the rear cover, the seal member fluidly separating an inner chamber between the main body and the rear cover from an outer chamber between the main body and the rear cover; and a processor within the inner chamber; a sensor module within the outer chamber; and a flex circuit connecting the sensor module to the processor and extending across the seal member.

Clause B: a watch comprising: a watch housing defining: an inner chamber; an outer chamber, wherein the inner chamber is fluidly sealed from the outer chamber and an external environment; and a channel for receiving a watchband; a processor within the inner chamber; and a sensor module that is within the outer chamber, operably connected to the processor, and coupled to the channel to detect the watchband when the watchband is inserted into the channel.

Clause C: a watch comprising: a main body having a channel for receiving a watchband and a first opening extending to the channel; a rear cover having a second opening; a button at least partially within the first opening and at least partially within the second opening, the button being moveable within the first opening and the second opening to interact with the watchband; and a sensor module within the button.

One or more of the above clauses can include one or more of the features described below. It is noted that any of the following clauses may be combined in any combination with each other, and placed into a respective independent clause, e.g., clause A, B, or C.

Clause 1: a touchscreen configured to display a visual output to a user and receive touch input from a user; a microphone; a speaker; and a communication component for communicating wirelessly with another device.

Clause 2: the main body has a first opening; the rear cover has a second opening; and the watch further comprises a button at least partially within the first opening and at least partially within the second opening.

Clause 3: the sensor module comprises an antenna module configured to obtain a characteristic of the watchband.

Clause 4: the antenna module comprises: a core structure; a coil antenna that is wound around the core structure; and an antenna filler surrounding the coil antenna and the core structure.

Clause 5: the sensor module is a first sensor module; the band retaining feature is a first band retaining feature; the watchband is a first watchband; the outer chamber is a first outer chamber; the sensor module is a first sensor module; the main body has a second band retaining feature for receiving a second watchband; the seal member fluidly separates the inner chamber from a second outer chamber between the main body and the rear cover; the watch further comprises a second sensor module within the second outer chamber; and the flex circuit connects the second sensor module to the processor and extends across the seal member.

Clause 6: a user sensor module within the inner chamber and configured to detect a characteristic of a user through the rear cover.

Clause 7: the watch housing comprises: a main body; and a rear cover.

Clause 8: the main body has a first opening; the rear cover has a second opening; and the watch further comprises a button at least partially within the first opening and at least partially within the second opening.

Clause 9: the sensor module is coupled to the channel by a cap having an outer surface that forms a portion of a surface of the channel.

Clause 10: the sensor module is a first sensor module; the channel is a first channel; the watchband is a first watchband; the outer chamber is a first outer chamber; the sensor module is a first sensor module; the watch housing further defines: a second outer chamber for receiving a second watchband; and a second channel for receiving a second watchband; and the watch further comprises a second sensor module that is within the second outer chamber, operably connected to the processor, and coupled to the second channel to detect the second watchband when the second watchband is inserted into the second channel.

Clause 11: a seal member between the main body and the rear cover, the seal member separating an inner chamber from the first opening and the second opening.

Clause 12: a processor within the inner chamber.

Clause 13: a flex circuit connecting the sensor module to the processor and extending across the seal member.

Clause 14: a portion of the flex circuit outside of the inner chamber defines a serpentine shape.

Clause 15: a spring element between the button and the main body, wherein the spring element biases the button against the rear cover, wherein the button is depressable away from the rear cover to release the watchband from the channel.

As described above, one aspect of the present technology may include the gathering and use of data available from various sources. The present disclosure contemplates that in some instances, this gathered data may include personal information data that uniquely identifies or can be used to contact or locate a specific person. Such personal information data can include demographic data, location-based data, telephone numbers, email addresses, twitter ID's, home addresses, data or records relating to a user's health or level of fitness (e.g., vital signs measurements, medication information, exercise information), date of birth, or any other identifying or personal information.

The present disclosure recognizes that the use of such personal information data, in the present technology, can be used to the benefit of users. For instance, health and fitness data may be used to provide insights into a user's general wellness, or may be used as positive feedback to individuals using technology to pursue wellness goals.

The present disclosure contemplates that the entities responsible for the collection, analysis, disclosure, transfer, storage, or other use of such personal information data will comply with well-established privacy policies and/or privacy practices. In particular, such entities should implement and consistently use privacy policies and practices that are generally recognized as meeting or exceeding industry or governmental requirements for maintaining personal information data private and secure. Such policies should be easily accessible by users, and should be updated as the collection and/or use of data changes. Personal information from users should be collected for legitimate and reasonable uses of the entity and not shared or sold outside of those legitimate uses. Further, such collection/sharing should occur after receiving the informed consent of the users. Additionally, such entities should consider taking any needed steps for safeguarding and securing access to such personal information data and ensuring that others with access to the personal information data adhere to their privacy policies and procedures. Further, such entities can subject themselves to evaluation by third parties to certify their adherence to widely accepted privacy policies and practices. In addition, policies and practices should be adapted for the particular types of personal information data being collected and/or accessed and adapted to applicable laws and standards, including jurisdiction-specific considerations. For instance, in the US, collection of or access to certain health data may be governed by federal and/or state laws, such as the Health Insurance Portability and Accountability Act (HIPAA); whereas health data in other countries may be subject to other regulations and policies and should be handled accordingly. Hence different privacy practices should be maintained for different personal data types in each country.

Despite the foregoing, the present disclosure also contemplates embodiments in which users selectively block the use of, or access to, personal information data. That is, the present disclosure contemplates that hardware and/or software elements can be provided to prevent or block access to such personal information data. For example, in the case of advertisement delivery services, the present technology can be configured to allow users to select to "opt in" or "opt out" of participation in the collection of personal information data during registration for services or anytime thereafter. In another example, users can select not to provide mood-associated data for targeted content delivery services. In yet another example, users can select to limit the length of time mood-associated data is maintained or entirely prohibit the development of a baseline mood profile. In addition to providing "opt in" and "opt out" options, the present disclosure contemplates providing notifications relating to the access or use of personal information. For instance, a user may be notified upon downloading an app that their personal information data will be accessed and then reminded again just before personal information data is accessed by the app.

Moreover, it is the intent of the present disclosure that personal information data should be managed and handled in a way to minimize risks of unintentional or unauthorized access or use. Risk can be minimized by limiting the collection of data and deleting data once it is no longer needed. In addition, and when applicable, including in certain health related applications, data de-identification can be used to protect a user's privacy. De-identification may be facilitated, when appropriate, by removing specific identifiers (e.g., date of birth, etc.), controlling the amount or specificity of data stored (e.g., collecting location data a city level rather than at an address level), controlling how data is stored (e.g., aggregating data across users), and/or other methods.

Therefore, although the present disclosure broadly covers use of personal information data to implement one or more various disclosed embodiments, the present disclosure also contemplates that the various embodiments can also be implemented without the need for accessing such personal information data. That is, the various embodiments of the present technology are not rendered inoperable due to the lack of all or a portion of such personal information data. For example, content can be selected and delivered to users by inferring preferences based on non-personal information data or a bare minimum amount of personal information, such as the content being requested by the device associated with a user, other non-personal information available to the content delivery services, or publicly available information.

A reference to an element in the singular is not intended to mean one and only one unless specifically so stated, but rather one or more. For example, "a" module may refer to one or more modules. An element proceeded by "a," "an," "the," or "said" does not, without further constraints, preclude the existence of additional same elements.

Headings and subheadings, if any, are used for convenience only and do not limit the invention. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

It is understood that the specific order or hierarchy of steps, operations, or processes disclosed is an illustration of exemplary approaches. Unless explicitly stated otherwise, it is understood that the specific order or hierarchy of steps, operations, or processes may be performed in different order. Some of the steps, operations, or processes may be performed simultaneously. The accompanying method claims, if any, present elements of the various steps, operations or processes in a sample order, and are not meant to be limited to the specific order or hierarchy presented. These may be performed in serial, linearly, in parallel or in different order. It should be understood that the described instructions, operations, and systems can generally be integrated together in a single software/hardware product or packaged into multiple software/hardware products.

In one aspect, a term coupled or the like may refer to being directly coupled. In another aspect, a term coupled or the like may refer to being indirectly coupled.

Terms such as top, bottom, front, rear, side, horizontal, vertical, and the like refer to an arbitrary frame of reference, rather than to the ordinary gravitational frame of reference. Thus, such a term may extend upwardly, downwardly, diagonally, or horizontally in a gravitational frame of reference.

The disclosure is provided to enable any person skilled in the art to practice the various aspects described herein. In some instances, well-known structures and components are shown in block diagram form in order to avoid obscuring the concepts of the subject technology. The disclosure provides various examples of the subject technology, and the subject technology is not limited to these examples. Various modifications to these aspects will be readily apparent to those skilled in the art, and the principles described herein may be applied to other aspects.

All structural and functional equivalents to the elements of the various aspects described throughout the disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for".

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language of the claims and to encompass all legal equivalents. Notwithstanding, none of the claims are intended to embrace subject matter that fails to satisfy the requirements of the applicable patent law, nor should they be interpreted in such a way.

What is claimed is:

1. A watch comprising:

a main body having a band retaining feature defining a space for receiving a watchband;

a rear cover;

a seal member between the main body and the rear cover, the seal member fluidly separating an inner chamber between the main body and the rear cover from an outer chamber between the main body and the rear cover;

a processor within the inner chamber;

a sensor module comprising an antenna module within the outer chamber and facing the band retaining feature;

a cap separating the space from the outer chamber, the cap being configured to transmit electromagnetic signals between the outer chamber and the space; and a flex circuit connecting the sensor module to the processor and extending across the seal member.

2. The watch of claim 1, further comprising:

a touchscreen configured to display a visual output to a user and receive touch input from the user;

a microphone;

a speaker; and a communication component for communicating wirelessly with another device.

3. The watch of claim 1, wherein:

the main body has a first opening;

the rear cover has a second opening; and the watch further comprises a button at least partially within the first opening and at least partially within the second opening.

4. The watch of claim 1, wherein the sensor module is configured to operate the antenna module to obtain a characteristic of the watchband.

5. The watch of claim 4, wherein the antenna module comprises:

a core structure;

a coil antenna that is wound around the core structure; and an antenna filler surrounding the coil antenna and the core structure.

6. The watch of claim 1, wherein:

the sensor module is a first sensor module;

the band retaining feature is a first band retaining feature;

the watchband is a first watchband;

the outer chamber is a first outer chamber;

the main body has a second band retaining feature for receiving a second watchband;

the seal member fluidly separates the inner chamber from a second outer chamber between the main body and the rear cover;

the watch further comprises a second sensor module within the second outer chamber; and the flex circuit connects the second sensor module to the processor and extends across the seal member.

7. The watch of claim 1, further comprising a user sensor module within the inner chamber and configured to detect a characteristic of a user through the rear cover.

8. A watch comprising:

a watch housing defining:

an inner chamber;

an outer chamber, wherein the inner chamber is fluidly sealed from the outer chamber and an external environment;

a channel for receiving a watchband; and a cap separating the channel from the inner chamber, the cap forming a portion of a surface of the channel;

a processor within the inner chamber; and a sensor module that is within the outer chamber, operably connected to the processor, and coupled to the channel by the cap to wirelessly detect the watchband through the cap when the watchband is inserted into the channel.

9. The watch of claim 8, wherein the watch housing comprises:

a main body; and a rear cover.

10. The watch of claim 9, wherein:

the main body has a first opening;

the rear cover has a second opening; and the watch further comprises a button at least partially within the first opening and at least partially within the second opening.

11. The watch of claim 8, wherein the sensor module comprises an antenna module configured to obtain a characteristic of the watchband.

12. The watch of claim 11, wherein the antenna module comprises:

a core structure;

a coil antenna that is wound around the core structure; and an antenna filler surrounding the coil antenna and the core structure.

13. The watch of claim 8, wherein:

the sensor module is a first sensor module;

the channel is a first channel;

the watchband is a first watchband;

the outer chamber is a first outer chamber;

the watch housing further defines:

a second outer chamber; and a second channel for receiving a second watchband; and the watch further comprises a second sensor module that is within the second outer chamber, operably connected to the processor, and coupled to the second channel to detect the second watchband when the second watchband is inserted into the second channel.

14. A watch comprising:

a main body having a channel for receiving a watchband and a first opening extending to the channel;

a rear cover having a second opening;

a button at least partially within the first opening and at least partially within the second opening, the button being moveable within the first opening and the second opening to interact with the watchband; and a sensor module within the button.

15. The watch of claim 14, further comprising a seal member between the main body and the rear cover, the seal member separating an inner chamber from the first opening and the second opening.

16. The watch of claim 15, further comprising a processor within the inner chamber.

17. The watch of claim 16, further comprising a flex circuit connecting the sensor module to the processor and extending across the seal member.

18. The watch of claim 17, wherein a portion of the flex circuit outside of the inner chamber defines a serpentine shape.

19. The watch of claim 14, further comprising a spring element between the button and the main body, wherein the spring element biases the button against the rear cover, wherein the button is depressable away from the rear cover to release the watchband from the channel.

* * * * *